United States Patent [19]

Diller

[11] 4,341,304

[45] Jul. 27, 1982

[54] TOOL TRAY

[76] Inventor: Harold L. Diller, 3980 Highland Dr., Mogadore, Ohio 44260

[21] Appl. No.: 196,006

[22] Filed: Oct. 10, 1980

[51] Int. Cl.[3] ..... B65D 43/00; B65D 61/00

[52] U.S. Cl. ..... 206/349; 108/44; 206/557; 224/42.42; 296/37.1

[58] Field of Search ..... 206/557, 349; 224/42.42 R; 296/37.1; 108/44

[56] References Cited

U.S. PATENT DOCUMENTS

| | | | |
|---|---|---|---|
| 2,670,260 | 2/1954 | Watt | 108/44 UX |
| 2,897,974 | 8/1959 | Cook | 224/42.42 R |
| 2,962,333 | 11/1960 | Policastro | 108/44 |
| 2,988,206 | 6/1961 | Olson | 224/42.42 R |
| 3,048,457 | 8/1962 | Haase | 108/44 |
| 3,394,849 | 7/1968 | Streeter | 224/42.42 R |
| 4,136,904 | 1/1979 | Lauderdale | 296/37.1 |
| 4,169,532 | 10/1979 | Scapellate | 206/557 |

*Primary Examiner*—William T. Dixson, Jr.

*Attorney, Agent, or Firm*—Oldham, Oldham, Hudak & Weber Co.

[57] ABSTRACT

A tray for use by diesel truck mechanics, designed and adapted for receipt and maintenance upon a tractor tire. Fundamentally, the invention includes a base comprising a rectangular box which is open at the bottom. Opposite ends of the base are each characterized by an opening of decreasing width from the bottom of the base upwardly, thus being adapted for receipt by various size tires with the crown of the tire being received through the open bottom of the base. Mounted atop the base is a tray which may be pivotally secured thereto.

9 Claims, 2 Drawing Figures

TOOL TRAY

BACKGROUND ART

The invention herein resides in the art of tool trays and the like and, more particularly, to such a tray for use in the trucking industry. Presently, cab-over-engine tractors have replaced the more conventional ones since the former accommodates a larger trailer while staying within federal guidelines for overall length. As the name implies, the engine and other mechanical systems of the cab-over-engine tractor is maintained beneath the cab itself in a rather compact and densely populated area. When a mechanic makes access to the engine, the cab is lifted forward and there is generally little area upon which the mechanic might place tools, parts, or repair equipment. Indeed, the engine itself is well encumbered with related apparatus such that no flat areas are available for receipt of such elements. Should elements be placed upon the engine block, they are often lost, overlooked, or forgotten during the mechanic's work efforts.

It has become common for cab-over-engine mechanics to utilize one of the front or steering tires of the tractor as a tray of sorts to receive tools, parts, and the like during servicing operations. These elements are placed at the top or crown of the tire, but with the tire being typically of a circular nature, there is only a small area than can receive such elements without having the same roll or fall therefrom. Similarly, the crown of the tire is too unstable to receive a tool tray and, in many situations, if the tool tray is merely set on the floor, its accessibility to the mechanic is severely limited.

DISCLOSURE OF INVENTION

In light of the foregoing, it is an object of an aspect of the instant invention to provide a tool tray which may be received by a tractor tire and supported on either side of the crown thereof.

Yet another object of an aspect of the invention is to provide a tool tray which may be received on a flat surface such as a floor or workbench, as well as being received upon a tire.

A further object of an aspect of the invention is to provide a tool tray which is rotatably and selectively positionable.

An additional object of an aspect of the invention is to provide a tool tray which is adapted to be received by tires of various sizes.

Yet another object of an aspect of the invention is to provide a tool tray which is reliable and durable in operation while being constructed utilizing state-of-the-art techniques and components.

The foregoing and other objects of the invention which will become apparent as the detailed description proceeds are achieved by a tool tray assembly, comprising: a base having a top interconnecting front and back plates at opposite ends thereof, said front and back plates having aligned openings therein, said base being open at the bottom thereof; and a tray maintained upon said top.

BRIEF DESCRIPTION OF DRAWING

For a complete understanding of the objects, techniques and structure of the invention, reference should be had to the following detailed description and accompanying drawing wherein.

BEST MODE FOR CARRYING OUT THE INVENTION

Figure 1:
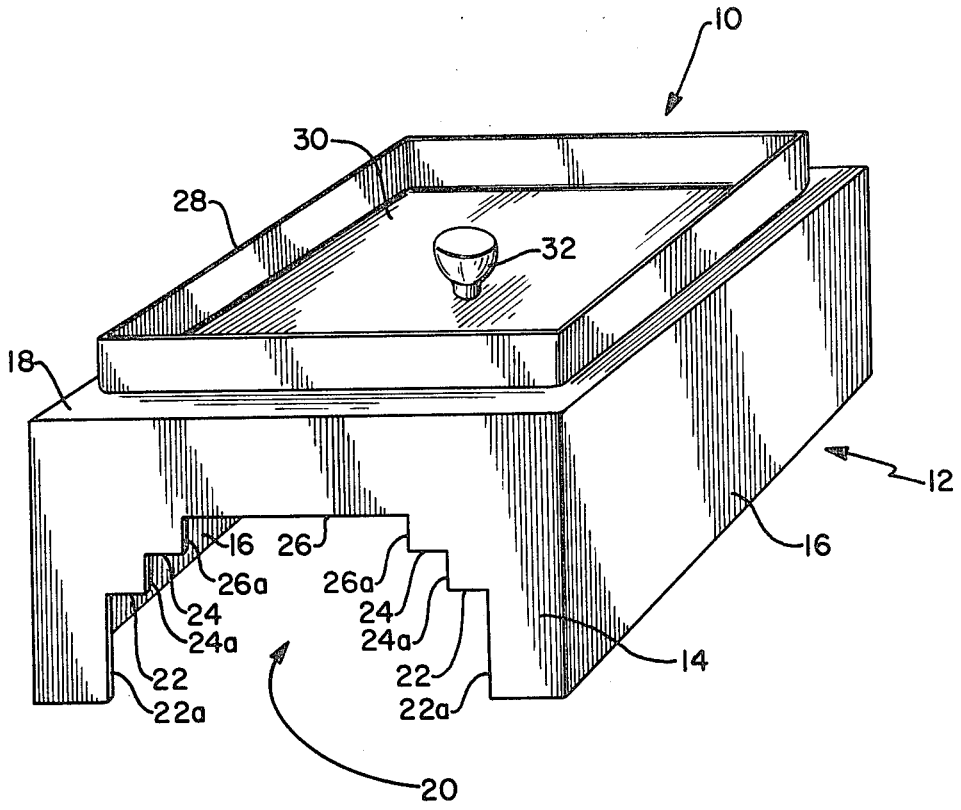
FIG. 1 is a perspective view of a first embodiment of the tool tray assembly of the invention.

Referring now to the drawing of FIG. 1, it can be seen that a tool tray made in accordance with the invention is designated generally by the numeral 10. It will be understood as this description proceeds that the components of the tool tray 10 may be of high impact plastic, sheet metal, or the like. The material for construction of the elements of the unit 10 need only be dictated by the considerations of wear and durability. In any event, the tool tray 10 includes a base 12 which is generally of a rectangular box construction. The base 12 includes front and back plates 14, preferably of equal size, and side plates 16, again of equal size. A top 18 interconnects the plates 14,16 at the top thereof, while the bottoms of the plates 14,16 lie within a plane defining an open bottom for the rectangular base 12.

Each of the front and back plates 14 are characterized by an opening 20 therein. The openings 20 are of decreasing width from the bottom of the plate 14 to the top of the opening, such top of the opening falling beneath the top 18 of the base 12. Preferably, the width of the opening 20 decreases in increments or steps as shown, and the bottom of the opening 20 communicates with and comprises a portion of the open bottom of the base 12.

The incremental changes in width of the opening 20, or the steps thereof, are defined by support edges 22,24,26 as shown in the drawing. Vertical edges **22*a*,24*a*,26*a*, orthogonally join the respective support edges 22,24,26. As will be discussed hereinafter, the separation between the vertical edges 22*a* would accommodate one width of tire, while the separation between the vertical edges 24*a* would accommodate a narrower width of tire, while the separation between the vertical edges 26*a*** would accommodate yet a final width of tire.

As further shown in the drawing, the tool tray assembly 10 includes a tray 28, shown as a unitary open tray having a lip or raised side about a bottom 30. It will be understood that the tray 28 could be compartmentalized by dividers extending between the lips if desired. A spindle 32 passes through registered openings in the bottom 30 and top 18 with appropriate heads on each side of the spindle to allow the tray 28 to rotate upon the top 18. As illustrated, the spindle 32 may include a knob or handle at the top thereof to facilitate handling. Such rotation allows for optimum positioning of tools, test equipment, parts, and the like, which might be received by the tool tray assembly 10.

It should now be appreciated that the tool tray of the invention may, with the plates 14,16 having the bottoms thereof in coplanar relationship, be received and maintained upon a floor, workbench, or the like. In such case, the tray 28, rotatable upon the top 18 of the base 12, allows optimum accessibility by the user to the tools, parts, equipment, and the like maintained thereby. Additionally, the openings 20 in the plates 14 are adapted for being received upon a tractor tire with the crown of the tire being received through the open bottom of the base 12 with appropriate support edges 22,24,26 being received on the tire edges on a cord passing through the tire circumference. For example, a tire having an 11.00 tread width might receive the support edges 22 with the vertical edges 22*a* of each of the plates 14 passing along the vertical side edges of the tread. Similarly, for a tractor tire having a width of 10.00, the tray might be received on the support edges 24 with the vertical edges 24*a* coming down along the sides of the tire tread. Finally, a tire having a tread width of 9.00 might receive the assembly 10 on the support edge 26 with the vertical edges 26*a* coming down alongside the tire tread.

It will be understood that the tray assembly 10 is preferably positioned with the high point of the crown of the tire at the center of the assembly with the appropriate support edges of the plates 14 being equally spaced on opposite sides of such crown. It will further be understood that the support edges 22,24,26 provide for vertical support, while the vertical edges 22*a*,24*a*,26*a* provide for lateral or horizontal support against the tire edge. Finally, with the plates 14 being made of plastic or sheet metal having a thickness on the order of approximately 0.010 inch, the support edges 22,24,26 will readily be received in very secure engagement by the treads on the tires.

Utilizing the structure of the invention, tools, test equipment, parts, and the like may be kept readily at hand at one centralized location while a mechanic performs operations on the cab-over-engine truck. The opening 20 in the plates 14 may be characterized by any number of steps or increments of width change, dependent upon the standard tire widths in the industry.

Figure 2:
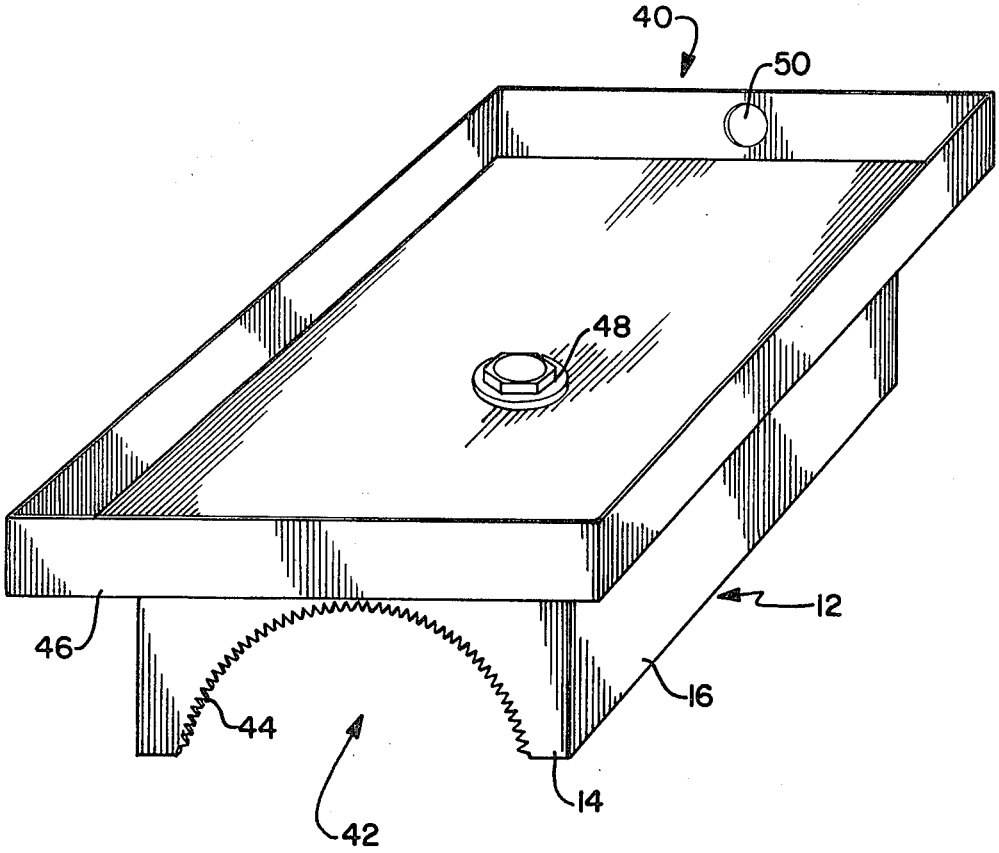
FIG. 2 is a perspective view of a second embodiment of the tool tray assembly of the invention.

With reference now to FIG. 2, a second tool tray embodiment of the invention is designated by the numeral 40. Again, a base 12 is provided having an open bottom and registered openings in the front and back plates 14. These openings 42 are of an arcuate nature, being widest at the open bottom of the base 12 as shown. The edges of the openings 42 are characterized by teeth or serrations 44 for making biting securing engagement with the truck tire, the arcuate openings 42 being of such contour as to accommodate the various sizes of tires as earlier discussed. Of course, the arcuate nature of the openings 42 are capable of being received by any size of tire not exceeding the width of the bottoms of such openings, the edges of the openings 42 making securing engagement with the edges of the tire.

As further shown in FIG. 2, the tray 46 may substantially overhang the base 12 to receive a large quantity of tools, parts, and the like. The tray 46 is again rotatable about a spindle 48 and is further characterized by a hole 50 therein for receiving a hook for storage of the assembly 40 on a wall, post, or other vertical surface.

Thus, it can be seen that the objects of the invention have been satisfied with the structures presented hereinabove. While in accordance with the patent statutes only the best modes and preferred embodiments of the invention has been presented and described in detail, it is to be understood that the invention is not limited thereto or thereby. Consequently, for an appreciation of the true scope and breadth of the invention, reference should be had to the following claims.

What is claimed is:

1. A tool tray assembly, comprising:

a base having top interconnecting front and back plates at opposite ends thereof, said front and back plates having aligned openings therein and said base being open at the bottom thereof;

a tray maintained upon said top; and wherein said aligned openings decrease in width incrementally in steps from the bottoms of said openings to the tops thereof.

2. The tool tray assembly according to claim 2 wherein said aligned openings in said front and back plates extend upwardly from bottom edges of said front and back plates, said bottom edges defining the bottom of said base.

3. The tool tray assembly according to claim 2 wherein said aligned openings are arcuate.

4. The tool tray assembly according to claim 1 which further includes a pair of side plates interconnecting said front and back plates at opposite edges thereof, and further being connected to said top.

5. The tool tray assembly according to claim 1 wherein said tray is pivotally mounted to said top.

6. The tool tray assembly according to claim 5 wherein said tray has a raised lip about the periphery thereof.

7. Apparatus for receiving tools and the like, comprising:

a base comprising a rectangular box of rigid sheet material and being open at the bottom thereof;

a tray pivotally maintained on top of said base; and wherein a pair of opposed ends of said rectangular box have openings therein, said openings extending from said bottom of said box upwardly toward said top of said box, and being of decreasing width from said bottom toward said top, said openings having serrated edges.

8. The apparatus as recited in claim 7 wherein the width of said openings decreases incrementally.

9. The apparatus as recited in claim 7 wherein said openings are arcuate.

* * * * *